US010954645B2

(12) United States Patent
DeBlauw

(10) Patent No.: US 10,954,645 B2
(45) Date of Patent: Mar. 23, 2021

(54) SYSTEM AND APPARATUS FOR DRIVING PILES

(71) Applicant: Christopher DeBlauw, Millersville, MD (US)

(72) Inventor: Christopher DeBlauw, Millersville, MD (US)

( * ) Notice: Subject to any disclaimer, the term of this patent is extended or adjusted under 35 U.S.C. 154(b) by 0 days.

(21) Appl. No.: 16/549,007

(22) Filed: Aug. 23, 2019

(65) Prior Publication Data

US 2021/0054588 A1 Feb. 25, 2021

(51) Int. Cl.

| | |
|---|---|
| ***E02D 7/00*** | (2006.01) |
| ***E02D 11/00*** | (2006.01) |
| ***E02D 23/00*** | (2006.01) |
| ***E02D 7/10*** | (2006.01) |
| ***E02D 5/24*** | (2006.01) |

(Continued)

(52) U.S. Cl.

CPC ..... *E02D 7/10* (2013.01); *E02D 5/24* (2013.01); *E02D 5/526* (2013.01); *E02D 7/14* (2013.01); *E02D 2200/1685* (2013.01); *E02D 2300/0029* (2013.01); *E02D 2600/20* (2013.01)

(58) Field of Classification Search

CPC .... E02D 7/10; E02D 7/14; E02D 5/24; E02D 5/526; E02D 2600/20; E02D 2200/1685; E02D 2300/0029

See application file for complete search history.

(56) References Cited

U.S. PATENT DOCUMENTS 137,514 A * 4/1873 Vogler ..... E02D 7/10 173/125
273,904 A * 3/1883 Skinner ..... E02D 7/10 173/127

(Continued)

*Primary Examiner* — Edwin J Toledo-Duran

(74) *Attorney, Agent, or Firm* — Laubscher & Laubscher, P.C.

(57) ABSTRACT

An apparatus for driving a pile section having a central opening into the ground includes a mast attachment with roped hydraulic cylinders, a high frequency hydraulic impact hammer connected with the mast, and a drive cap. The mast with roped hydraulic cylinders provides for vertical movement of the high frequency hydraulic impact hammer, and the drive cap connects with the high frequency hydraulic impact hammer and a pile section to transfer the drive force of the hammer to the pile section. When the mast is connected with an excavator and the drive cap is connected with the high frequency hydraulic impact hammer, a pile section is connected with the drive cap lower end and the high frequency hydraulic impact hammer is operated to drive the pile section into the ground.

A system for driving piles into the ground includes an excavator, an apparatus connected with the excavator, and a plurality of base pile sections. The pile sections have an upper end surface containing a central opening which connects with the apparatus prior to driving the pile sections into the ground. The apparatus includes a mast with roped hydraulic cylinders, a high frequency hydraulic impact hammer connected with the mast, and a drive cap. The mast with roped hydraulic cylinders provides for vertical movement of the high frequency hydraulic impact hammer, and the drive cap connects with the high frequency hydraulic impact hammer and a pile section to transfer the drive force of the hammer to the pile section.

11 Claims, 5 Drawing Sheets

(51) Int. Cl.
*E02D 5/52* (2006.01)
*E02D 7/14* (2006.01)

(56) References Cited

U.S. PATENT DOCUMENTS 461,796 A * 10/1891 Marsh ..... E02D 7/10 173/127
1,954,070 A * 4/1934 Cook ..... E02D 5/523 405/254
3,034,304 A * 5/1962 Upson ..... E02D 5/48 405/243
3,172,485 A * 3/1965 Spannhake ..... E02D 7/20 173/147
3,237,406 A * 3/1966 Spannhake ..... B21J 7/24 60/371
3,283,832 A * 11/1966 Spannbake ..... E02D 7/10 173/126
3,356,164 A * 12/1967 Wadsworth ..... E02D 7/26 173/102
3,398,801 A * 8/1968 Kotone ..... B25D 9/14 173/16
3,537,536 A * 11/1970 Cordes ..... E02D 7/10 173/92
3,679,005 A * 7/1972 Inaba ..... B21J 7/26 173/128
3,935,908 A * 2/1976 Pepe ..... E02D 7/10 173/127
3,939,922 A * 2/1976 Swenson ..... E02D 7/10 173/125
3,991,833 A * 11/1976 Ruppert ..... E02D 13/10 173/20
4,020,804 A * 5/1977 Bailey ..... F02B 71/02 123/46 R
4,043,405 A * 8/1977 Kuhn ..... E02D 7/10 173/127
4,055,224 A * 10/1977 Wallers ..... E02D 15/08 175/5
4,091,800 A * 5/1978 Fletcher ..... F24S 10/13 126/567
4,154,307 A * 5/1979 Gendron ..... E02D 7/02 173/21
4,268,993 A * 5/1981 Cunningham ..... E01C 13/083 405/37
4,371,041 A * 2/1983 Becker ..... E21B 19/02 173/28
4,802,538 A * 2/1989 Hays ..... E02D 7/08 173/1
4,966,492 A * 10/1990 Poyda ..... E02D 31/004 405/129.5
5,002,432 A * 3/1991 Dysarz ..... E02D 9/04 166/55.2
5,542,784 A * 8/1996 G.ang.rdenberg ..... E21B 7/20 299/13
5,894,781 A * 4/1999 Kuvshinov ..... E02D 7/10 91/246
5,934,836 A * 8/1999 Rupiper ..... B09C 1/00 405/236
6,000,477 A * 12/1999 Campling ..... E02D 7/10 173/100
6,234,719 B1 * 5/2001 Roynestad ..... E02D 7/26 173/1
6,427,987 B1 * 8/2002 Campling ..... E02D 7/06 267/69
6,652,190 B1 * 11/2003 Verkyk ..... E21B 7/205 175/62
8,784,008 B2 * 7/2014 Dudding ..... B09B 1/004 405/129.95
8,944,720 B2 * 2/2015 Nolt ..... B65G 5/00 405/54
9,783,944 B2 * 10/2017 Ragsdale, Jr. ..... E02B 3/10
10,407,860 B2 * 9/2019 Jinnings ..... B25D 9/06
2005/0247461 A1 * 11/2005 Cardoso ..... E02D 13/06 173/13
2014/0003870 A1 * 1/2014 Wendt ..... E02D 5/06 405/285
2014/0262393 A1 * 9/2014 Desmeules ..... E02D 7/06 173/29
2016/0090707 A1 * 3/2016 Korherr ..... E02D 7/10 405/232

* cited by examiner

SYSTEM AND APPARATUS FOR DRIVING PILES

BACKGROUND OF THE DISCLOSURE

The present disclosure relates to a system and apparatus for driving piles, and specifically for installing deep foundation pile systems.

The deep foundation industry has used technology to incrementally increase the capacity of an individual piling/caisson element. The more capacity per element, the less elements needed to support a structure. Less elements have intuitively meant less cost. The implementation of hydraulics has increased the size of equipment and subsequently the forces that a deep foundation rig can utilize to increase the capacity of a single foundation element. This coupled with computer aided controls, which has increased over the past two decades, has led to even larger and more complex equipment in all facets of the industry.

As the size of equipment has increased, systems have become more complicated, harder to maintain and difficult to operate. Large equipment is also more expensive to service and to move from site to site. Further, computers and electronics are not conducive to construction sites, which typically include a surrounding environment that can be harmful to such technology. All of these factors have driven up the overall cost of purchasing, using and maintaining such equipment.

As the size and cost of the equipment has risen, the tooling needed by the equipment has also increased. Likewise, the materials installed by such systems are long, heavy and expensive. The size of the materials often requires a large support crane to handle the material and deliver it to the foundation installation equipment. Adding a crane to the overall system increases time and cost. Cranes are expensive and carry with them an increased liability, further driving up the overall cost of a project. Beyond the crane itself, a certified crane operator is needed, adding to the challenges of using the current systems and materials in the deep foundation industry. All of these issues have made deep foundation systems challenging, inefficient, and ultimately more costly than they should be. There is a need for a system that reduces or removes the challenges noted above, providing for a smaller, more cost effective and efficient solution.

SUMMARY OF THE DISCLOSURE

Accordingly, it is an object of the present disclosure to provide a system and apparatus for installing deep foundation pile systems that overcomes the drawbacks of those currently used in the field.

The apparatus includes a mast having roped hydraulic cylinders, a high frequency hydraulic impact hammer connected with the mast, and a drive cap. The mast with roped hydraulic cylinders provides for vertical movement of the high frequency hydraulic impact hammer, and the drive cap connects with the high frequency hydraulic impact hammer and a pile section to transfer the drive force of the hammer to the pile section. The high frequency hydraulic impact hammer is operable to provide an impact and vibration force via a projection tool arranged at its lower end. The drive cap has a projection at a lower end which connects with the pile section and an upper end containing an opening to receive the hammer projection tool. When the mast is connected with an excavator and the drive cap is connected with the high frequency hydraulic impact hammer, a pile section is connected with the drive cap lower end and the high frequency hydraulic impact hammer is operated to drive the pile section into the ground. In a preferred embodiment, the upper end of the mast includes a winch for lifting and aligning the pile section with a ground surface.

The system of the present disclosure includes an excavator, an apparatus connected with the excavator, and a plurality of base pile sections. The pile sections have an upper end surface containing a central opening which connects with the apparatus prior to driving the pile sections into the ground. The apparatus includes a mast with roped hydraulic cylinders, a high frequency hydraulic impact hammer connected with the mast, and a drive cap, as described above. The mast with roped hydraulic cylinders provides for vertical movement of the high frequency hydraulic impact hammer, and the drive cap connects with the high frequency hydraulic impact hammer and a pile section to transfer the drive force of the hammer to the pile section.

In a second embodiment, the system further includes a plurality of extension pile sections each having an upper end surface containing a central opening and a lower end with a pile splice attached thereto. The splices are welded to the extension pile sections at a shop or factory prior to their use in the field, and are configured for a dry fit connection—i.e. no weld or hardware connection is needed—with the upper end surface of the plurality of base pile sections. Once a base pile section has been driven into the ground, an extension pile section is connected with the base pile section via the splice and is driven into the ground by the high frequency hydraulic impact hammer to form a deeper foundation system.

In yet another embodiment, the plurality of base pile sections include a lower end having a tip connected therewith. Preferably, the tip is one of a flat tip, a rock tip, a rock tip with pin, and an expanded tip.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1A:
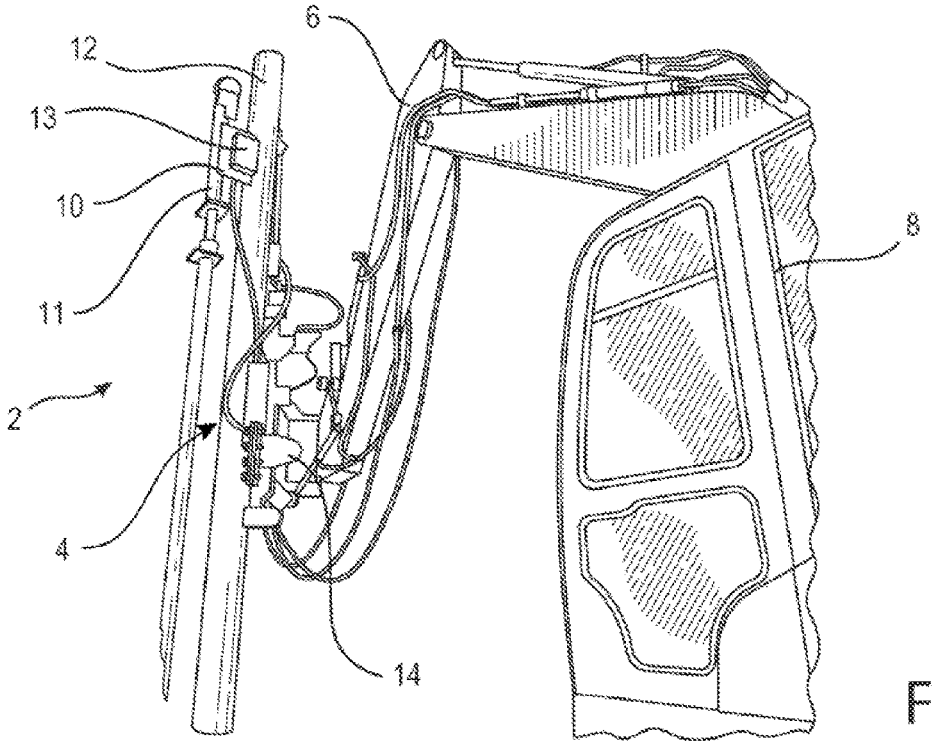
FIGS. 1A and 1B are perspective views of one embodiment of the apparatus and system disclosed herein.

The present disclosure relates to an apparatus and system for installing deep foundation piles. The apparatus and system include less expensive, smaller, simpler, more agile and operator friendly equipment that has a lower maintenance cost, requires limited support equipment and tooling, and greatly reduces risks as compared to those currently used in the industry. A dry fit splice connection (also referred to herein as a coupler) is included to increase efficiency.

FIGS. 1A-3 show a first embodiment of the system 2 which includes an apparatus 4 connected with a main boom 6 of an excavator 8. The apparatus includes a high frequency hydraulic impact hammer 10 having a housing 11 connected with a mast attachment assembly 13 which is mounted within a mast 12. The mast is connected with the excavator via an attachment assembly 14. Most systems or apparatuses in the industry involve large rigs and cranes, requiring specialized knowledge and skills. For the present system, anyone who can competently operate an excavator can implement the system. The mast can range in height depending on project requirements. In one instance, the mast is as short as nine feet to fit within an existing building, and in other instances the mast is as tall as twenty-four feet for larger projects or exterior applications.

Figure 1B:
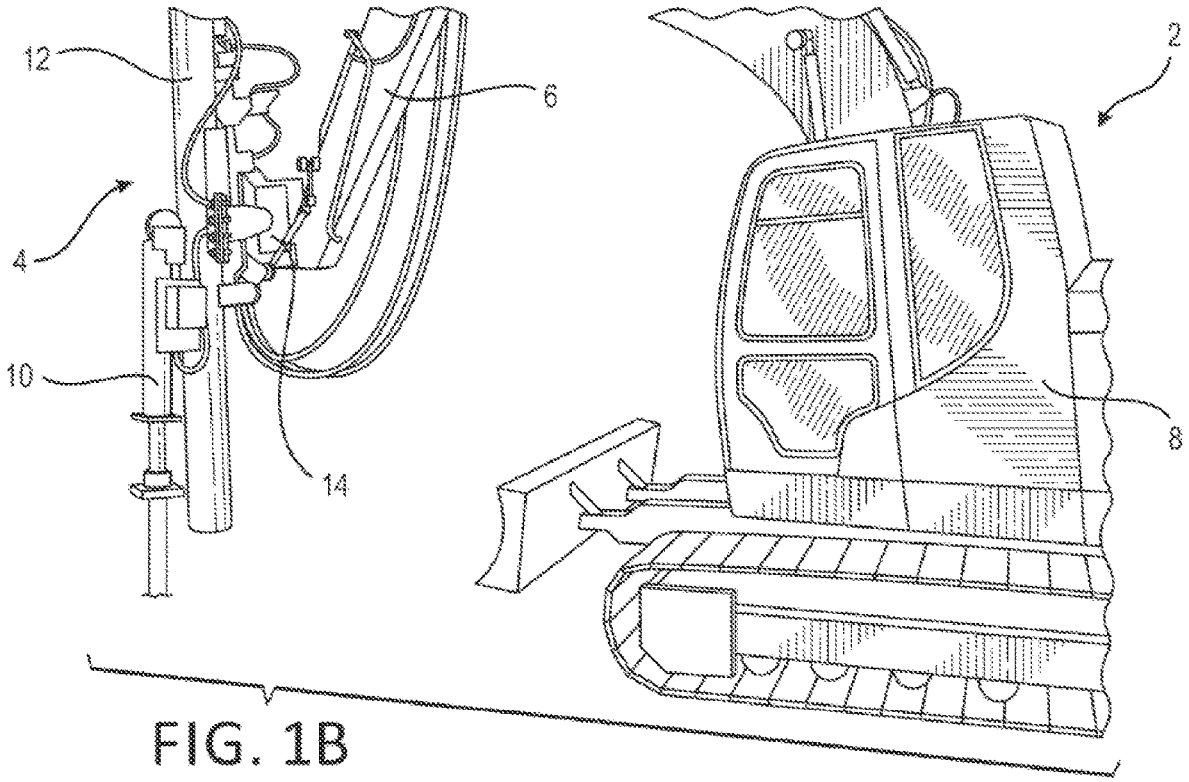
Figure 2:
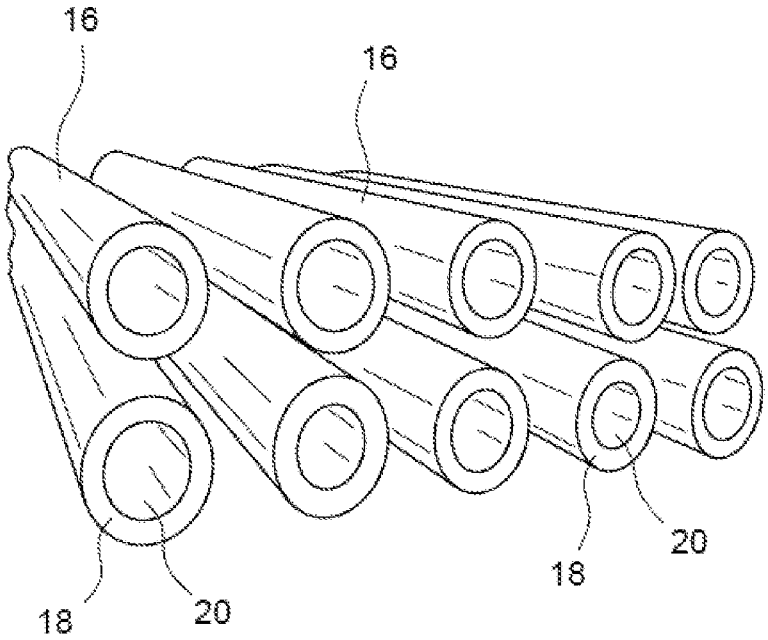
FIG. 2 is a perspective view of a plurality of base pipe sections.
Figure 3:
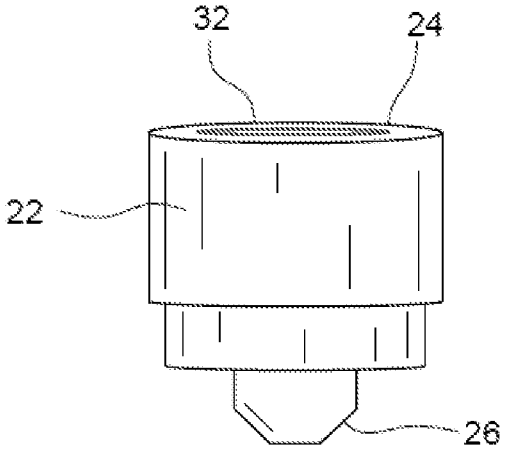
FIG. 3 is a perspective view of a drive cap according to the apparatus disclosed herein.

Further to the system 2, FIG. 2 shows a plurality of base pile sections 16 each having an upper end surface 18 containing a central opening 20. When the mast 12 is connected with the excavator 8 as shown in FIGS. 1A and 1B and a base pile section is aligned with a ground surface, a drive cap 22 (FIG. 3) is connected with the high frequency hydraulic impact hammer 10 at its upper end 24 and a pile section opening 20 at its lower end 26. The hammer is operated to drive the pile section into the ground until the bearing stratum is achieved. The process is continued with additional spaced pile sections to form a deep foundation system. It will be understood by those with skill in the art that the number of piles will be dependent on the loading requirements of the given structure.

The piles of FIG. 2 are high strength, heavy-wall pipes, which are typically costly. However, for use with the present system, the pipes are preferably sourced from secondary markets, such as the secondary oil field market, which provide pipes of high quality and high strength for lower cost. Though advantageous to use lower-cost pipes, such pipes are not required to implement the system disclosed herein.

Figure 4:
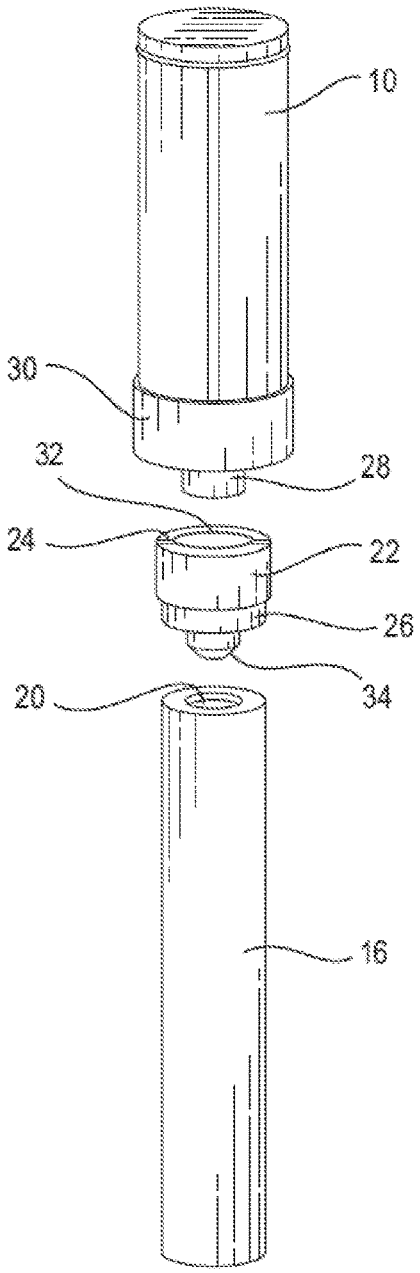
FIG. 4 is an exploded view of a pile, a drive cap, and a high frequency hydraulic impact hammer according to one embodiment of the present disclosure.

FIG. 4 is an exploded view of the hammer 10, drive cap 22 and pile section 16 shown in FIGS. 1A-3. The hammer is a high-frequency hydraulic impact hammer that is connected with the drive cap via a hammer projection tool 28 arranged at the lower end 30 of the hammer and an opening 32 arranged at the upper end 24 of the drive cap, respectively. The drive cap is a solid piece of high-strength steel that is machined to fit over the projection tool to transfer the driving energy of the hammer to a pile section.

Once the hammer 10 and drive cap 22 are connected, a pile section 16 is aligned with a ground surface and connected with the drive cap via a drive cap lower end projection 34 and the pile upper end opening 20. The hammer 10 is then operated to drive the pile into the ground surface to a desired depth to form one portion of a deep foundation system. Subsequent piles are connected with the drive cap to be driven into specific locations in the ground until the deep foundation system is complete. The drive cap remains connected with the hammer until all piles have been driven into the ground. When operated, the high frequency hydraulic impact hammer creates an impact force and, depending on the level of the frequency, a vibratory force at the tip of the pile, which together improves the driving efficiency over other known systems which use only vibration or impact alone.

For deep foundation pile systems, it is often important to know soil parameters to determine the pile design needed to support a specific load. This is typically based on borings, which involve drilling into a ground surface and testing the soil. The soil is often tested with a "split spoon" sampling process. The split spoon is driven into the soil stratum with a 140-pound hammer dropped thirty inches, counting the number of blows to drive the split spoon one foot.

Though not required for each installation of the presently defined system, in a preferred embodiment, in addition to or alternative to soil testing with borings and a split spoon sampling, each pile is itself a test pile which provides the strength characteristics of the soil. When a split spoon sample is taken, a rod having the split spoon attached to its lower end is driven into a soil stratum via a 140-pound drop hammer that falls 30 inches. When dropped, the blows per foot are recorded. This provides a known, calibrated amount of energy that is required to drive a pile into the ground. Then, when a pile is being driven into the ground surface, and the bearing stratum is thought to have been reached, the high-frequency hydraulic impact hammer is slowed to a rate such that each blow to the pile can be counted. This criteria is defined in blows per inch of pile movement. The total blow count is compared to borings or to a load test previously performed on a sample pile. The total blows at the bearing stratum for each pile are then used to determine the total energy applied to each pile and thus a tested, verified capacity of each pile is known.

Figure 5:
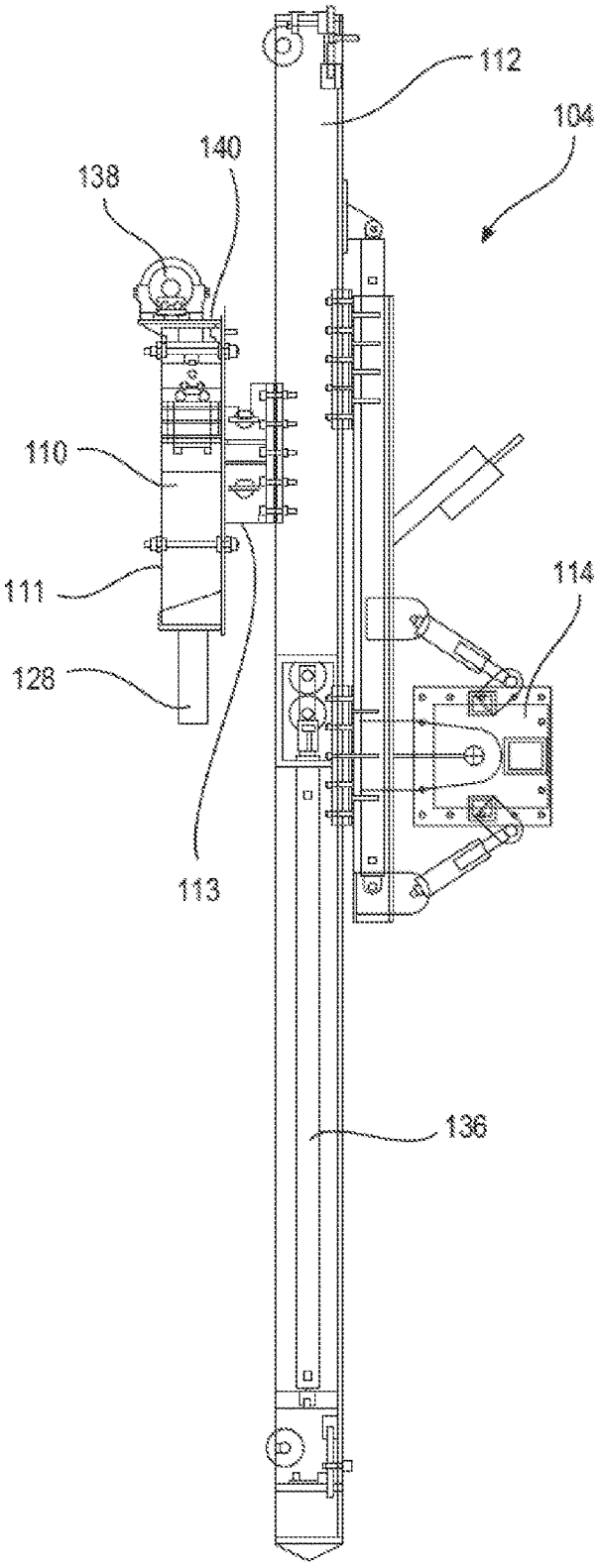
FIG. 5 is front view of a mast and hammer according to one embodiment of the present disclosure.

FIG. 5 shows a detailed rendering of the elements of a second embodiment of the apparatus 104, which includes a mast 112, a mast attachment assembly 113, and a hammer 110, which includes a housing 111 and a projection tool 128 extending through a lower end of the housing. The mast includes an attachment assembly 114 for attaching the mast with an excavator (as shown in FIGS. 1A and 1B), and roped hydraulic cylinders 136, a term of art that will be understood by those having ordinary skill in the art, for providing vertical movement of the hammer. A winch 138 is connected with an upper end 140 of the hammer, which is used for lifting and aligning pile sections with a ground surface. This significantly reduces the support equipment and personnel needed to use the system components and install piles, which results in lower labor costs. In most cases, the apparatus and system can be used with a three-person crew. In some instances only an operator and ground person are needed. Conversely, the conventional pile driving rigs of known systems typically require a five to seven-person crew. Here, the installation rig is able to manage and deliver material to the installation location without support equipment.

In the deep foundation industry, most pile sections are driven by a low frequency impact hammer or a high frequency vibratory hammer. Those hammers are being manufactured in ever increasing sizes to drive larger pile elements, resulting in hammers that are less efficient. Through a number of developments and experiments with other systems and apparatuses, it became apparent that for the present system and apparatus, the high frequency hydraulic impact hammer provided more efficient installation than other hammers. That hammer, in combination with the mast and other elements described herein, provides for an immediate impact force at the tip of the pile, which is efficient for penetration of sand, silt, clay, weathered rock or a combination thereof. In addition, the high frequency of the impact hammer also provides a localized vibration force at the tip of the pile, which is efficient for cohesionless soils, such as sand. These two forces in combination provide for a more efficient installation process in a range of soil conditions.

As noted above, the pipes are preferably sourced from the oil field secondary market where some pipes are discarded because of tolerance issues. Such pipes do not meet the standards of the oil field industry, but are high strength materials, perfect for deep foundation systems. These pipes will stand up to the driving forces of the present system and apparatus and provide increased axial capacity for a pile at a much lower price. The pipes are readily available from known sources in US markets. Though pipes sourced from oil field secondary markets are contemplated for the present system, such pipes are not required.

Piles used in all deep foundation systems have both a structural and a geotechnical capacity. The structural capacity relates to the threshold of weight that can be applied to a pile before it is deformed, and the geotechnical capacity relates to the load which the soils can resist. The heavy-wall pipes of the present system have a high structural capacity and can be driven to non-compressible material, such as disintegrated rock, which provides full geotechnical capacity.

Figure 6:
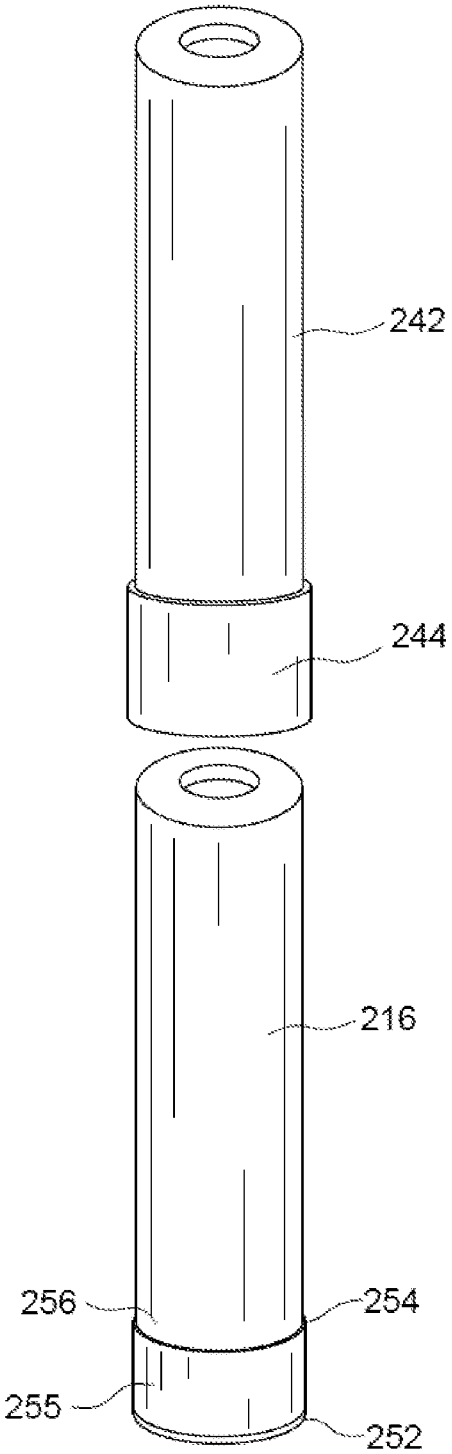
FIG. 6 is an exploded view of a base pile with a flat tip, an extension pile, and a splice according to one embodiment of the present disclosure.

FIG. 6 shows pile sections of another embodiment of the system disclosed herein. There is an extension pile section 242 in addition to a base pile section 216. The extension pile includes a splice 244 for connecting that section with the base pile section. The splice and extension pile are welded together, preferably at a shop or factory prior to hauling the foundation piles to a project site. On site, once the base pile section is driven into the ground, the splice is slipped over its upper end via a dry fit splice connection without having to weld the splice to the base pile section or use of connection hardware. This differs from other pile systems that require welding the base pile and splice, which is handled on site, slowing the overall process and significantly increasing costs. Using a splice/slip coupler to connect the base pile with the extension piles simplifies the overall process, increasing the efficiency of installing a deep foundation system.

Figure 7:
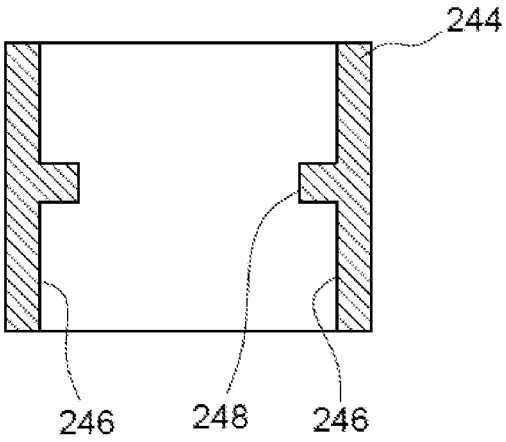
FIG. 7 is a front cross-sectional view of a pile splice comprising a dry fit coupler according to one embodiment of the present disclosure.

As shown in the cross-sectional view of FIG. 7, the inner surface 246 of the splice 244 has a centrally located projection 248 and is configured so as to fit over the outer surface of the end of each pile section 216, 242.

The extension piles 242 and splices 244 are typically used when shorter base piles are required. This is often the case when installing a deep foundation system in confined spaces or limited access projects. Although base piles 216 for such systems must be shorter, the foundational depth of a specific project might require a depth that is greater than the length of the base pile, thus the extension piles are used to create a deeper foundation.

The splice 244 connects the extension pile section 242, which can be of varied length, to the base pile section 216. Once the splice is placed over the base pile section, installation of the extension pile begins without welding the splice to the base pile. Preferably, splices are made from a heavy-wall pipe that has a slightly greater diameter than that of the base and extension pile sections. The ends of the splice are machined such that they fit over the base and extension pile sections to create a secure connection between the two.

In one embodiment, the splice 244 is milled from a 5-inch, 0.490 wall high strength pipe section. This is similar in strength to the pipes used for the base 216 and extension 242 pile sections. It will be understood by those with skill in the art that the dimensions of the splice can vary with different piles and deep foundation systems.

Figure 8:
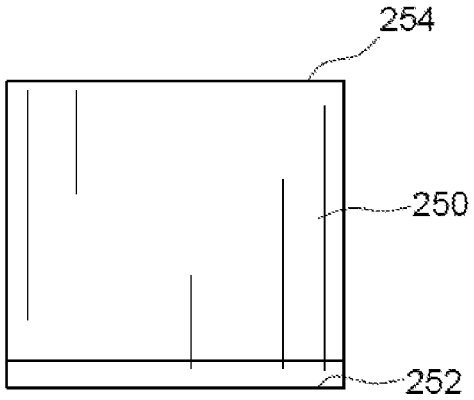
FIG. 8 is a front view of a tip attachment according to one embodiment of the present disclosure.

FIGS. 6 and 8 show a first pile tip 250 having a flat lower end 252 and an open upper end 254. In FIG. 6, the upper end of the tip is connected to the lower end 256 of the base pile section 216 to close it off prior to driving the pile into the ground. The tip is connected via a dry fit, with no welding or hardware required.

Figure 9:
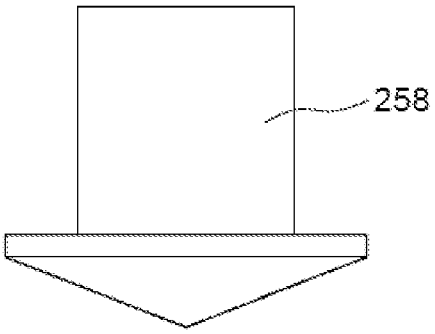
FIGS. 9 and 10 are front views of further tip attachments, respectively, according to additional embodiments of the present disclosure.
Figure 10:
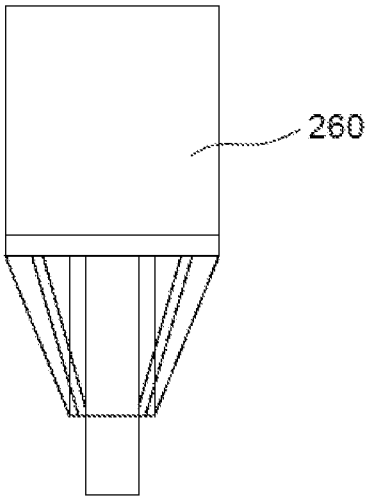

FIGS. 9 and 10 show additional embodiments of tip attachments. The attachments aid in driving a pile by allowing the pile to more efficiently cut through a specific condition, which is needed when the flat and/or open end of a pile is not sufficient. The tips of FIGS. 9 and 10 include an expanded tip 258 and a rock tip 260 with a hardened pin 262, respectively. The expanded tip is utilized when an opening in the surrounding soils musts be larger than the pile shaft itself to facilitate the use of grout around the pile shaft. In this case, the grouted outer shaft increases the ability of the pile to develop friction capacity of the pile.

The system and apparatus disclosed herein provide the ability to replace larger costly elements with a greater number of smaller elements while still increasing the cost/capacity ratio, which is based on dollars per ton of load supported by the element. Further, the combination of the hammer and drive cap provides for effective installation rates in both cohesive soils, for instance clay, and non-cohesive soils, for instance sand, as well as weathered rock.

Often, soils encountered in deep foundation projects are a combination of clay and sand or silt. Conventional high impact and high energy hammers, such as those used to drive large piles for bridge abutments, result in intense vibrations that can cause damage to nearby structures. Non-impact vibratory hammers produce the same unwanted condition. This limits the use of either type of hammer for installing foundation systems near adjacent structures, such as buildings, railways and utilities. The present system and apparatus are used to install deep foundations immediately adjacent to such structures and buildings, for instance, historic facades, protected buildings, sensitive utilities and railway tracks. Because the energy is concentrated at the tip of the pile and does not radiate towards the adjacent structures, those structures are not affected. The high frequency hydraulic impact hammers of the present apparatus are light compared to the amount of energy they deliver. Thus, the energy to weight ratio is high, allowing the hammers to be mounted in a light duty mast which is mounted to an excavator for more efficient use and to provide better access.

In addition, low frequency impact hammers will often damage the heavy-walled pipes of the present system. The high frequency hydraulic impact hammer of the present system and apparatus has been found to more adequately drive piles, including into weather rock and to limited depths of other rock, depending on the quality of the rock, without damaging the pile material.

Because the present system and apparatus include smaller equipment compared to other foundation systems or apparatuses, it is particularly useful in urban areas where there is a need to install piling inside existing buildings and in very tight access areas. The size of excavators, the mast height, and the pile length can all be varied to meet the needs of a specific project. Foundations can be installed in as little as ten feet of headroom with five-foot pile sections. Other known systems and apparatuses cannot handle such installations. For installing foundation systems outside, pile lengths can be much larger, for instance as long as forty-five feet, though typical lengths for outdoors installation are fifteen feet. The elements of the present system and apparatus are adaptable to a range of projects with different needs.

Although the above description with reference to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. An apparatus for driving a pile section having a central opening into the ground, comprising:

a. pile driving mast including an elongated post having an outer surface;

b. a mast attachment assembly connected with said post outer surface for vertical movement along a length of said mast;

c. a high frequency hydraulic impact hammer, including:

i. a housing having an outer surface connected with said mast attachment assembly; and ii. a projection tool arranged at a lower end of said housing operable to provide at least one of an impact and vibration force;

d. at least one roped hydraulic cylinder connected with said mast attachment assembly for displacing mast attachment assembly relative to said mast; and e. a drive cap connected with said high frequency hydraulic impact hammer and having a projection at a lower end configured for connection with the pile section via the central opening and an upper end containing an opening configured to receive said projection tool, whereby when said mast is connected with an excavator and said drive cap is connected with the pile section, said at least one roped hydraulic cylinder is operated to move said high frequency hydraulic impact hammer relative to said pile driving mast to drive the pile section into the ground.

2. The apparatus for driving a pile section as defined in claim 1, and further comprising a winch connected with an upper end of said mast for lifting and aligning the pile section with a ground surface.

3. A system for driving piles into the ground, comprising:

a. an excavator;

b. an apparatus connected with said excavator, comprising:

i. a pile driving mast including an elongated post having an outer surface;

ii. a mast attachment assembly connected with said post outer surface for vertical movement along a length of said mast;

iii. a high frequency hydraulic impact hammer, including:

1. a housing having an outer surface connected with said mast attachment assembly; and 2. a projection tool arranged at a lower end of said housing operable to provide at least one of an impact and vibration force;

iv. at least one roped hydraulic cylinder connected with said mast attachment assembly for displacing said mast attachment assembly relative to said mast; and v. a drive cap connected with said high frequency hydraulic impact hammer and having a lower end projection configured for connection with a pile section central opening and an upper end containing an opening configured to receive said projection tool; and c. a plurality of base pile sections each having an upper end surface containing a central opening, whereby when said plurality of pile sections are driven into the ground via said apparatus in spaced relation, a deep foundation is formed.

4. The system as defined in claim 3, wherein said apparatus further comprises a winch connected with an upper end of said mast for lifting and aligning said plurality of base pile sections with a ground surface.

5. The system as defined in claim 3, and further comprising a plurality of extension pile sections each having an upper end surface containing a central opening and a lower end with a splice attached thereto, said splice being configured for connection with an upper end of said plurality of base pile sections, whereby when said plurality of base pile sections are driven into the ground, each of said plurality of extension pile sections are connected with each of said plurality of base pile sections and driven into the ground by said high frequency hydraulic impact hammer to form a deeper foundation.

6. The system as defined in claim 5, wherein each pile splice comprises a slip coupler for a dry fit connection with a base pile section.

7. The system as defined in claim 3, wherein each of said base pile sections comprises a high strength, heavy wall pipe.

8. The system as defined in claim 7, wherein said heavy wall pipe has a length between 5 and 45 feet and a diameter between 3.5 and 8.5 inches.

9. The system as defined in claim 7, wherein said heavy wall pipe comprises a new oil field secondary market pipe.

10. The system as defined in claim 3, wherein at least one of said plurality of base pile sections includes a lower end having a tip connected therewith.

11. The system as defined in claim 10, wherein said tip is one of a flat tip, a rock tip, a rock tip with pin, and an expanded tip.

* * * * *